US008632345B2

(12) United States Patent
Shibata et al.

(10) Patent No.: US 8,632,345 B2
(45) Date of Patent: Jan. 21, 2014

(54) LOW PROFILE CONNECTION SYSTEM

(75) Inventors: Yusuke Shibata, Tokyo (JP); Toshihiro Niitsu, Tokyo (JP)

(73) Assignee: Molex Incorporated, Lisle, IL (US)

( * ) Notice: Subject to any disclaimer, the term of this patent is extended or adjusted under 35 U.S.C. 154(b) by 85 days.

(21) Appl. No.: 13/452,103

(22) Filed: Apr. 20, 2012

(65) Prior Publication Data

US 2012/0270446 A1 Oct. 25, 2012

(30) Foreign Application Priority Data

Apr. 20, 2011 (JP) ..... 2011-093615

(51) Int. Cl.
*H01R 12/00* (2006.01)

(52) U.S. Cl.
USPC ..... 439/74

(58) Field of Classification Search
USPC ..... 439/74, 83, 660, 862
See application file for complete search history.

(56) References Cited

U.S. PATENT DOCUMENTS

| | | | | |
|---|---|---|---|---|
| 6,923,659 | B2 * | 8/2005 | Zhang et al. | 439/74 |
| 7,287,988 | B1 * | 10/2007 | Peng et al. | 439/74 |
| 7,789,673 | B2 * | 9/2010 | Lee et al. | 439/74 |
| 7,845,987 | B2 * | 12/2010 | Yamada et al. | 439/680 |
| 7,931,477 | B2 * | 4/2011 | Hirata et al. | 439/74 |

FOREIGN PATENT DOCUMENTS

| | | |
|---|---|---|
| JP | 2009-199823 | 9/2009 |

* cited by examiner

*Primary Examiner* — Khiem Nguyen
(74) *Attorney, Agent, or Firm* — Timothy M. Morella

(57) ABSTRACT

Accordingly, the board-to-board connector of the Present Disclosure comprises a first connector mounted on a surface of a first board and a second connector mounted on a surface of a second board and mating with the first connector. The first connector includes a flat-shaped main body part, a first conductive body placed on the mating surface of the main body part, and a plurality of male terminals protruding from the surface of the first conductive body. The second connector is a flat-shaped material formed from flat-shaped metal, and includes a plurality of female terminals flexibly retaining the male terminals. Positioning of the male and female terminals is accomplished by the male terminals being retained by the female terminals.

20 Claims, 18 Drawing Sheets

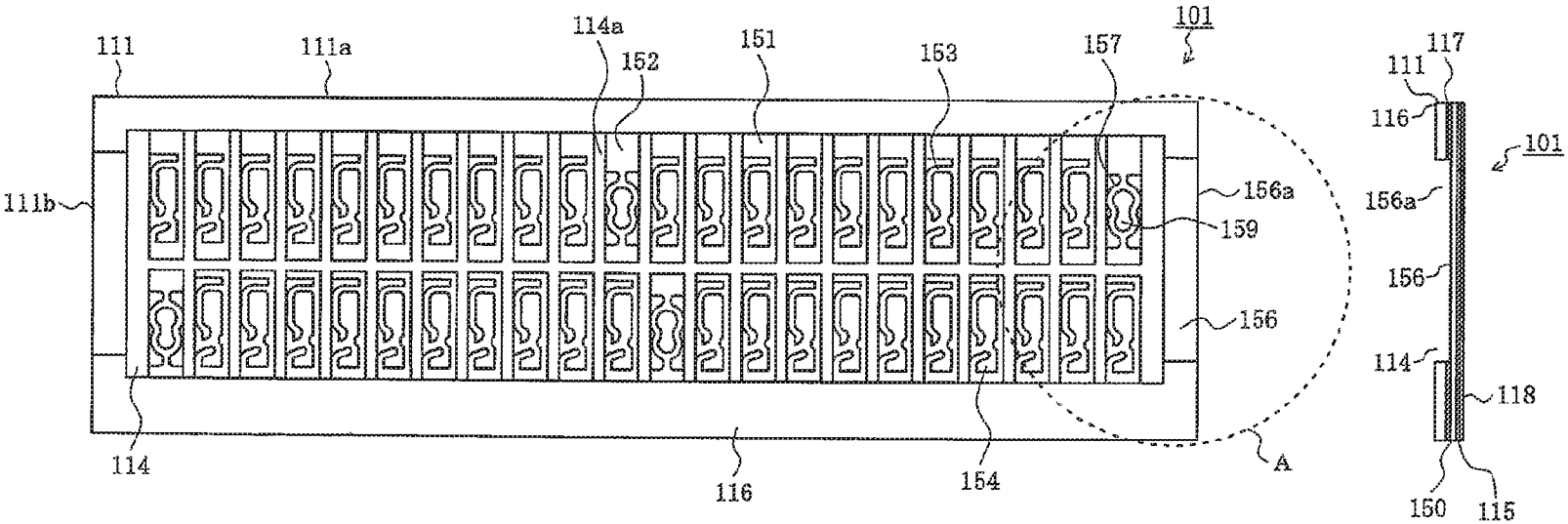
FIG. 5A
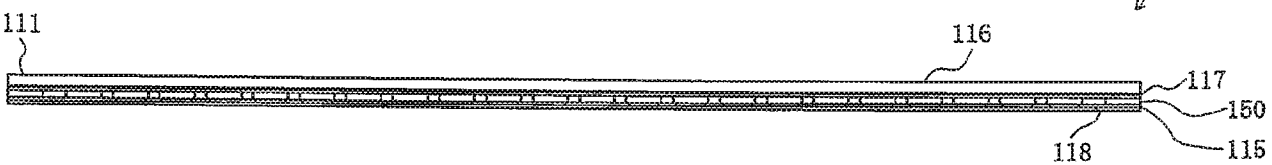
FIG. 5B
FIG. 5C

LOW PROFILE CONNECTION SYSTEM

REFERENCE TO RELATED APPLICATIONS

The Present Disclosure claims priority to prior-filed Japanese Patent Application No. 2011-093615, entitled "Board-To-Board Connector," filed on 20 Apr. 2011 with the Japanese Patent Office. The content of the aforementioned Patent Application is incorporated in its entirety herein.

BACKGROUND OF THE PRESENT DISCLOSURE

The Present Disclosure relates, generally, to a board-to-board connector, and, more particularly, to a reduced-height board-to-board connector that maintains stable contact and is able to produce an appropriate click sensation, signifying the connection.

Board-to-board connectors have typically been used to electrically connect pairs of parallel circuit boards. Such connectors are mounted on mutually facing surfaces of a pair of circuit boards, and joined so as have electrical conduction. An example is disclosed in Japanese Patent Application No. 2008-038965, the content of which is incorporated herein in its entirety.

FIG. 18 is a cross sectional illustration showing a conventional board-to-board connector. In the Fig., 811 is a first housing, being the housing for a first connector mounted on first circuit board 891, and 911 is a second housing, being the housing for a second connector mounted on second circuit board 991. First circuit board 891 and second circuit board 991 are electrically connected by joining the first and second connectors. The first housing 811 is provided with a recessed part 812, and first terminals 861 are implanted within the recessed part 812. Each first terminal 861 is provided with a tail part 862 soldered to connection pads of first circuit board 891, and a contact part 865 that contacts with a second terminal 961 on the second connector. In addition, second terminals 961 are implanted in the second housing 911. Each second terminal 961 is provided with a tail part 962 soldered to connection pads of second circuit board 991, and a contact part 965 that contacts with a first terminal 861 on the first connector.

In addition, when the first and second connectors are joined, contacts parts 865 of first terminals 861 and contact parts 965 of second connector 961 are joined, as first terminals 861 and second terminals are mated together. By this means, first terminals 861 and second terminals 961 are electrically connected. In addition, a click sensation is produced when first terminals 861 and second terminals 961 are mated, and thereby the operator is able to verify that the joining of the first and second connector has been completed. In addition, first terminals 861 and second terminals 961 are in locked state, and joining of the first and second connectors is thus assured.

However, second housing 911 is made to insert into recessed part 812 of first housing 811, and therefore the overall height dimensions of the first and second connectors are large. In addition, a click sensation is produced when first terminals 861 and second terminals 961 are mated, but the click sensation is weak and in some cases cannot be sensed by the operator.

SUMMARY OF THE PRESENT DISCLOSURE

One purpose of the Present Disclosure, in resolving the aforementioned problems of typical board-to-board connectors, is a board-to-board connector whereby the first connector is provided with protruding male connectors and the second connector is provided with female terminals formed with flat-shaped metal and flexibly encloses the male terminals. Thereby, the board-to-board connector is able to reduce the height dimension and maintain stable contact, whereby positioning of the male and female terminals is assured, as well as to produce an appropriate click sensation. In addition, the connector is also easy to manufacture with a simple and low-cost configuration and compact size, and is highly reliable.

Accordingly, the board-to-board connector of the Present Disclosure comprises a first connector mounted on a surface of a first board and a second connector mounted on a surface of a second board and mating with the first connector. The first connector includes a flat-shaped main body part, a first conductive body placed on the mating surface of the main body part, and a plurality of male terminals protruding from the surface of the first conductive body. The second connector is a flat-shaped material formed from flat-shaped metal, and includes a plurality of female terminals flexibly retaining the male terminals. Positioning of the male and female terminals is accomplished by the male terminals being retained by the female terminals.

In another board-to-board connector according to the Present Disclosure, after the mating surfaces of the first connector and second connector are mutually aligned, they are joined by sliding together. In yet another board-to-board connector according to the Present Disclosure, the female terminals contain a first terminal material, a second terminal material and a third terminal material formed by patterning of a second conductive body made of flat shaped metal. The first and second terminal materials contain a base part connected to peripheral parts of the female terminal on the second conductor. They also contain flexibly displaceable contact parts and beam parts linking the contact parts with the base parts. The spaces between the contact parts of the first, second and third terminal materials are smaller than the cross section of the male terminals. Thus, when the female terminals are joined with the male terminals, the contact parts of the first, second and third materials flexibly retain the side surfaces of the male terminals. In yet another board-to-board connector according to the Present Disclosure, an aperture is formed on the inside of the first terminal material and is larger than the cross section of the male terminal. The male terminal, after being inserted into the aperture, moves between the third terminal material and the contact parts of the first and second terminal materials, and is retained thereby. In yet another board-to-board connector according to the Present Disclosure, the second connector further contains a click sensation supplying material that supplies a click sensation generated when the male terminal is retained by the female material. The click sensation supplying material is formed from flat-shaped metal, and contains a mutually facing pair of a first and second arm parts, and a raised part connecting the ends of the first and second arm parts. A click sensation is generated when the male terminal, having penetrated between two of the first arms, passes between the raised areas, and moves between the second arms. In yet another board-to-board connector according to the Present Disclosure, the main body part of the first connector contains catch parts extending outward from both longitudinal ends. The second connector contains a connecting recessed area accommodating the main body part of the first connector, and a frame defining the perimeter of the connecting recessed area. The frame contains catch parts extending outward from the inner end edges of vertical frame parts positioned at both longitudinal ends thereof. When the main body part of the first connector is accommodated in the connecting recessed area of the second connector, the main body part catch and the frame catch parts lock together. In yet another board-to-board connector according to the Present Disclosure, the frame contains spring parts formed on vertical frame parts and positioned at both longitudinal ends. When the main body part of the first connector is accommodated in the connecting recessed area of the second connector, the main body catch and the frame spring parts lock together.

By means of the Present Disclosure, in a board-to-board connector, a first connector is provided with a protruding male part, and a second connector is provided with a female part, formed of flat-shaped metal, which flexibly holds the male part. By means thereof, it is possible to reduce the height dimension of the first and second connectors, and it is possible to assure positioning of the male and female terminals, and to hold the connection in a stable fashion. In addition, because an appropriate clicking sensation is produced, it is possible to easily know when fitting is completed. Further, it is possible to increase reliability, along with easy manufacturing, simple and low-cost configuration, and compact size.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which:

FIG. 5 is a series of illustrations of the second connector of FIG. 4, whereby (*a*) is a top view, (*b*) is a front view, and (*c*) is a side view;

DESCRIPTION OF THE PREFERRED EMBODIMENTS

While the Present Disclosure may be susceptible to embodiment in different forms, there is shown in the Figures, will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Referring to the Figures, male connector 1, being a first connector that is one side of a board-to-board connector according to the first preferred embodiment, being a surface-mount type connector mounted as a mounted component on the surface of first board 91, is electrically connected to female connector 101, being a second connector that is the corresponding connector as described below. The female connector 101 is a surface-mount type connector mounted as a mounted component on the surface of second board 191. Specifically, a board-to-board connector contains the aforementioned male connector 1 and female connector 101, and electrically connects a first board 91 and a second board 191. Note also that the aforementioned first board 91 and second board 191 may be, for example, circuit boards used in electronic devices etc.

Figure 1:
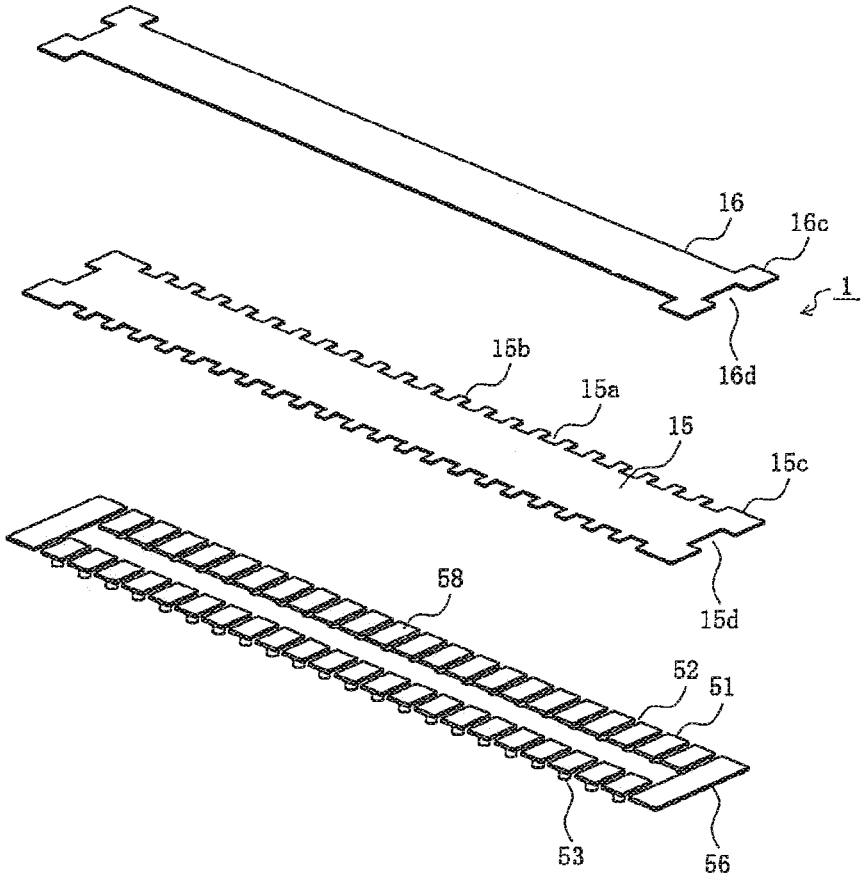
FIG. 1 is an exploded diagram showing the layer configuration of a first connector according to the first preferred embodiment of the Present Disclosure.

The male connector 1 has main body part 11, planar in shape with a flat rectangular surface. Both ends in the longitudinal direction (the horizontal direction in FIG. 2(*a*)) of the main body 11 function as main body ends 11*c* extending laterally (the vertical direction in FIG. 2(*a*)), and the main end parts 11*c* contain cutout parts 11*d*. In addition, the main body parts 11 also have, in order from the mounting surface side, reinforcing layer 16, a reinforcing panel of flat thin panel material; base film 15, a male base panel part of the first panel part that is an insulative reinforcing panel material with a thin band shape; and conductive patterns 51, male conductive bodies functioning as a first conductor with a multiplicity of electroconductive lines arrayed in parallel on one side (the bottom side in FIG. 1) of the base film 15.

The base film 15 is formed of any type of material having insulative properties. Also, on the other side of the base film 15 (the top side in FIG. 1) is placed reinforcing layer 16 as a reinforcing panel part of flat film material. In addition, both ends of the base film 15 in the longitudinal direction (the horizontal direction in FIG. 2(*a*)) function as base film ends 15*c* extending laterally (the vertical direction in FIG. 2(*a*)), and the base film ends 15*c* contain cutout parts 15*d*. Similarly, both longitudinal ends of reinforcing layer 16 function as laterally extending reinforcing layer ends 16*c*, and the reinforcing ends 16 have cutout parts 16*d*. The cutout parts lid of main body part 11 are comprised of cutout parts 15*d* of base film 15, and cutout parts 16*d* of reinforcing layer 16.

Figure 3:
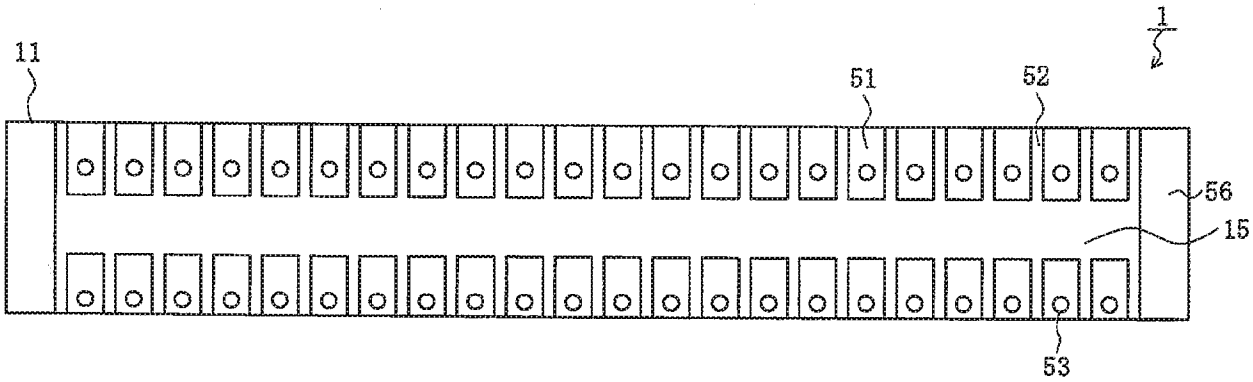
FIG. 3 is a plane illustration of the first connector of FIG. 1, showing the mating surface.

The conductive patterns 51 are formed beforehand by, for example, application and patterning by etching processes, etc. of copper leaf having thickness on the order of several μm to several tens of μm adhering to one side of base film 15, and adjacent conductive patterns 51 are placed so as to extend in the front-to-back direction (the up-and-down direction in FIG. 3) of male connector 1, and mutually parallel to each other, and separated by pattern separation spaces 52. Each conductive pattern 51 is exposed to the mating surface of main body part 11 and also has one protruding terminal 53 as a male terminal. Each the protruding terminal 53 is a material protruding from the surface of conductive pattern 51, and is formed as one body with conductive pattern 51 by a method such as etching, etc.

Figure 2A:
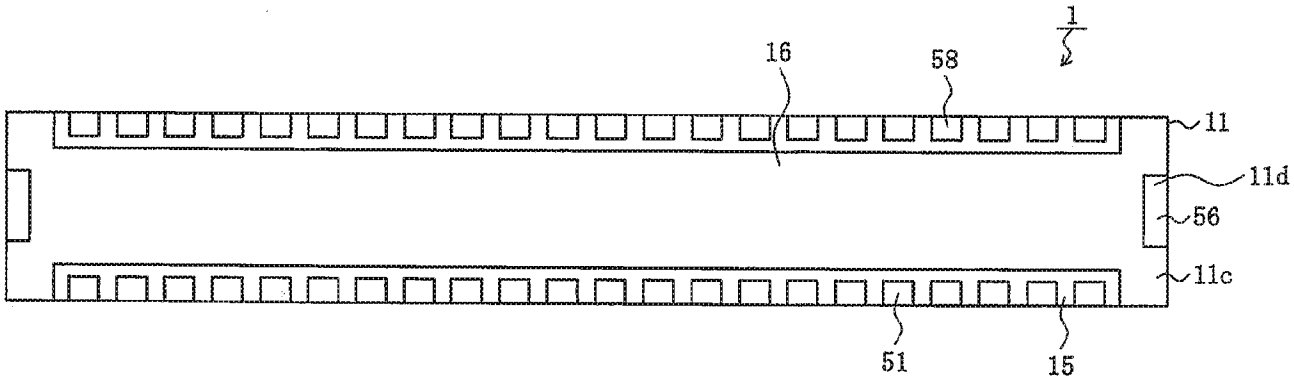
FIG. 2 is a series of illustrations of the first connector of FIG. 1, whereby (*a*) is a top view, (*b*) is a front view, and (*c*) is a side view.
Figure 2B:
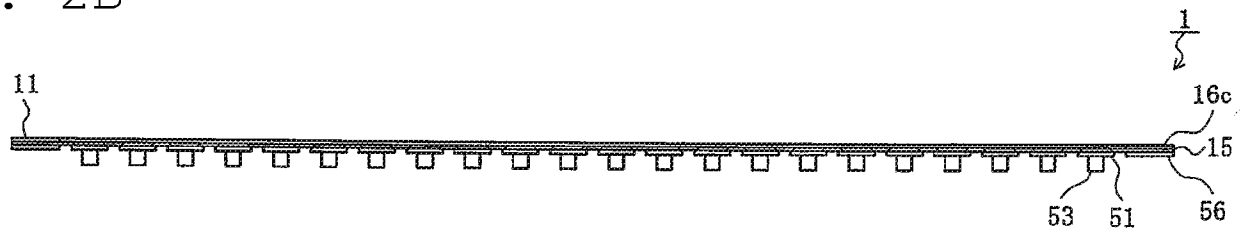
Figure 2C:
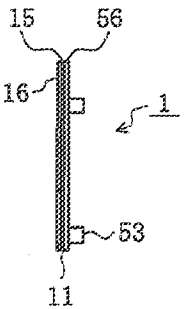

Note also that in the aforementioned base film 15, a multiplicity of recessed areas 15*a* is formed in the front edge part and back edge part facing outwards and extending in the longitudinal direction, and parts between adjacent recessed areas 15*a* form protruding parts 15*b* like the teeth of a comb. In the example shown in FIG. 1 the upper right side (the upper side in FIG. 3) is the front side, and the lower left side (the bottom side in FIG. 3) is the back side. Also, the position of each recessed area 15*a* is appropriate to the position of the corresponding conductive pattern 51. By this means, a portion of the back surface of each conductive pattern 51 is exposed on the mounting surface of main body 11 as shown in FIG. 2(*a*). The exposed area is the area of conductive pattern 51 corresponding to recessed area 15*a*, and functions as tail part 58, connected to conductive pads formed on the surface of first connector 91, not shown. By this means, male connector 1 is attached to first board 91, and conductive patterns 51 and protruding terminals 53 are an a state of being electrically connected to the connection pads of first board 91.

In addition, reinforcing fixtures 56 are placed on the side of the aforementioned conductive patterns 51, and function as mating protruding parts. The reinforcing fixtures 56 are formed by, for example, application and patterning by etching processing, etc. of copper plate having thickness on the order of several μm to several tens of μm adhering to one side of base film 15, and are placed longitudinally on main body 11 extending in the front-to-back direction of main body 11, and are separated from conductive patterns 51.

On the mounting surface of main body 11, a portion of the back side of the aforementioned reinforcing fixtures 56 is exposed from cutout part 11*d*, and the exposed part is connected by soldering, etc. to fixing pads formed on the front side of first board 91. By this means, male connector 1 is attached by means of first board 91. In addition, the reinforcing fixtures 56 are inserted into mating recessed parts 156*a* of female connector 101, described below, and thus act as positioning guides for male connector 1 and female connector 101.

In this first preferred embodiment, female connector 101 is the other, or second, connector in the board-to-board connector, has a rectangular flat shape, and is electrically connected to the male connector in the aforementioned first connector, and in addition is mounted to the surface of second board 191, a printed circuit board, or flexible circuit board, etc. described below. In this case, the female connector 101 is flat in shape, is mounted so that the back surface thereof corresponds to the surface of second connector 191, and is electrically connected to conductive traces on second board 191.

The female connector 101 has a flat frame body 111 with a surface shape that is approximately box-shaped. The frame body 111 has horizontal frame parts 111*a* extending longitudinally on female connector 101 (horizontally in FIG. 5(*a*)), and vertical frame parts 111*b* linked at both ends to the horizontal frame parts 111*a*. Note also that mating recessed parts 156*a* are formed in the center part of the vertical frame parts 111*b* and mate with main body end parts 11*c* containing reinforcing fixtures 56 of male connector 1.

Further, the flat recessed part having a rectangular planar shape with its perimeter described by the frame 111 is connecting recessed part 114, which accommodates main body part 11 of male connector 1. Note also that in this first preferred embodiment, the parts of the main body part 11 with the exception of main body ends 11*c* are accommodated in the connecting recessed part 114. Bottom part 114*a* of the connecting recessed part 114 is of a flat planar material having a laminated structure whereby reinforcing layer 118, base film 115, and conductive pattern 150 are laminated in that order, from the mounting surface side (the bottom side in FIG. 4). The base film 115 is formed of any type of material having insulative properties.

The conductive patterns 150 contain female conductive bodies 151 functioning as a second conductive body having a multiplicity of electroconductive lines, and are formed by, for example, application and patterning by etching processes etc. of copper leaf having spring-like properties and thickness on the order of several μm to several tens of μm. Also, the conductive patterns 150 contain supplementary conductive bodies 152, which function as a joining retention material.

The supplementary conductive bodies 152, like the female conductive bodies 151, are formed by, for example, application and patterning by etching processes etc. of copper leaf having springlike properties.

In the example shown in the Figures, conductive patterns 150 are placed so as to extend in the front-to-back direction (the up-and-down direction in FIG. 5*a*) of female connector 101, and mutually parallel to each other, and separated by pattern separation spaces 150*a*. Also, in the example shown in the Figures, a total of four the supplementary conductive bodies 152 are placed in the longitudinal direction at both ends and in the vicinity of the center. Note also that female conductive bodies 151 are not present in locations where supplementary conductive bodies 152 are placed. Specifically, in the example shown in the Figures, four female conductive bodies 151 are replaced by supplementary conductive bodies 152.

Figure 6:
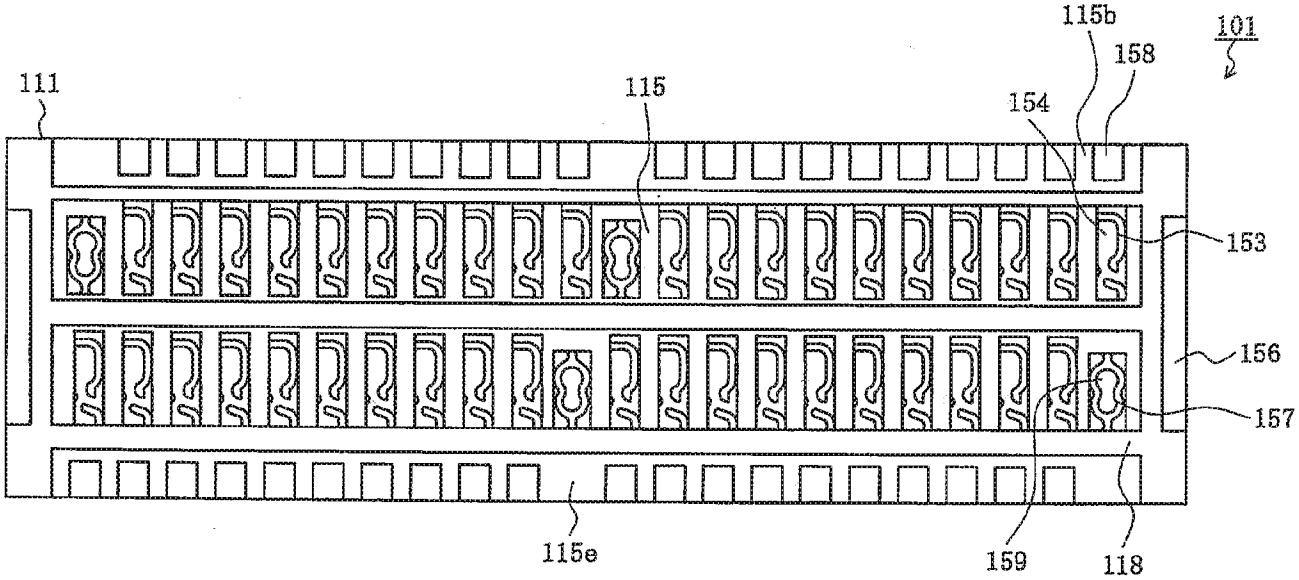
FIG. 6 is a plane illustration of the second connector of FIG. 4, showing the mating surface.
Figure 7:
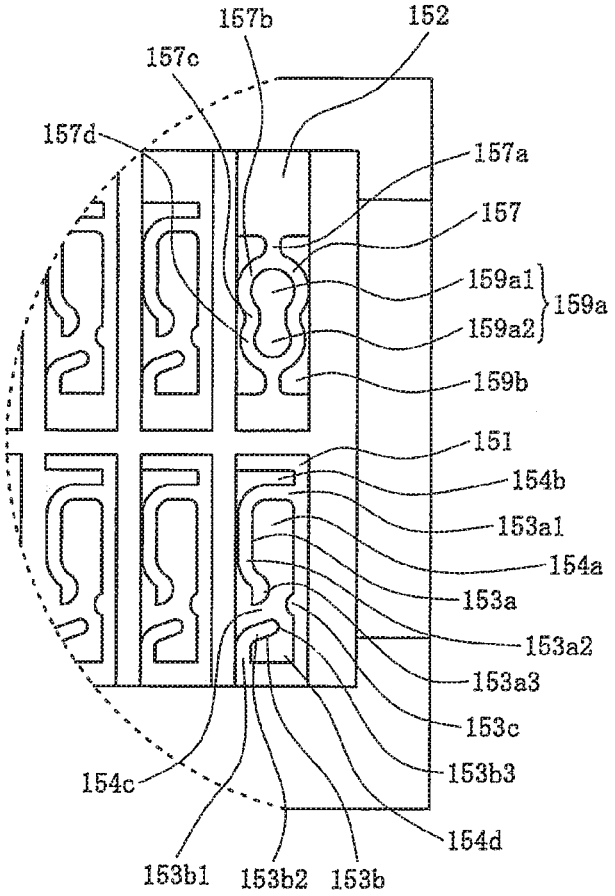
FIG. 7 is an expanded illustration of essential parts of the second connector of FIG. 4, being an enlarged view of Part A of FIG. 5.

Note also that in the base film 115, a multiplicity of recessed parts 115*a* is formed in the front edge part and back edge part facing outwards and extending in the longitudinal direction, and parts between adjacent recessed parts 115*a* form protruding parts 115*b* like the teeth of a comb. In the example shown in FIG. 4, the lower left side (the lower side in FIG. 6) is the front side, and the upper right side (the upper side in FIG. 6) is the back side. Also, the position of each recessed part 115*a* matches the position of the corresponding female conductive body 151. By this means, a portion of the back surface of each female conductive body 151 is exposed on the mounting surface of female connector 101 as shown in FIG. 6. The exposed portions are the portions corresponding to recessed parts 115*a* on female conductive bodies 151, and function as tail parts 158, connected by soldering etc. to connection pads formed on the surface of second board 191, not shown. By this means female connector 101 is mounted on second board 191 and also female conductive bodies 151 are in a state of being electrically connected to connecting pads on second board 191. Note also that no recessed parts 115*a* are formed in positions corresponding to supplementary conductive bodies 152, and lateral protruding parts 115*e* are formed so as to be wider than the protruding parts 115*b*. For this reason, no parts corresponding to the tail parts 158 are present on the back side of supplementary conductive bodies 152.

Also, reinforcing fixtures 156 are placed on the sides of the aforementioned conductive patterns 150, and function as the bottom part of mating recessed parts 156*a*. The reinforcing fixtures 156 are formed together with the conductive patterns 150 by, for example, application and patterning by etching processing etc. of copper plate having springlike properties, and are placed longitudinally on female connector 101 extending in the front-to-back direction of female connector 101, and separated from conductive patterns 150. A portion of the back surface of the reinforcing fixtures 156 is exposed on the mounting surface of female connector 101, and the exposed part is connected by soldering etc. to positioning pads formed on the front surface of second board 191, not shown. By this means, female connector 101 is firmly attached by means of second board 191.

Receiving terminals 153 are placed as female terminals in areas corresponding to bottom parts 114*a* of connecting recessed areas 114 on the aforementioned female conductive bodies 151. Similarly, retaining parts 157 are placed as materials for completing a clicking sensation, on areas corresponding to bottom parts 114*a* of connecting recessed areas 114 on the aforementioned supplementary conductive bodies 152. The receiving terminals 153 and retaining parts 157 are materials that mate with protruding terminals 53 of male connector 1, and therefore are arrayed in the same array as the protruding terminals 53. Thus in the event of modification of the arrangement of protruding terminals 53, the arrangement of receiving terminals 153 is modified in a manner so as to correspond thereto. In addition, the arrangement of conductive patterns 150 is also the same as the arrangement of conductive patterns 51 on male connector 1, and in the event that the arrangement of conductive patterns 51 on male connector 1 is modified, the arrangement of conductive patterns 150 is modified in a manner so as to correspond thereto.

Each of the receiving terminals 153 is a material enclosed by terminal enclosing apertures 154, which are approximately rectangular in shape and pass through conductive patterns 150 in the thickness direction, and is formed by patterning of conductive patterns 150 by a method such as etching etc. using photolithography technology. Typically, receiving terminals 153 are the remaining pattern formed by patterning of conductive patterns 150, and terminal receiving apertures 154 are parts where material around the periphery of the receiving terminals 153 is removed. As a result, the thickness dimension of receiving terminals 153 is equal to the thickness dimension of conductive patterns 150.

The retaining parts 157 also are material enclosed within retaining part enclosure apertures 159, which are approximately rectangular in shape and pass through conductive patterns 150 in the thickness direction, and like receiving terminals 153, are formed by patterning of conductive patterns 150 by a method such as etching etc. using photolithography technology. Typically, retaining parts 157 are the remaining pattern formed by patterning of conductive pattern 150, and retaining part enclosure apertures 159 are parts where material around the periphery of the retaining parts 157 is removed. As a result, the thickness dimension of retaining parts 157 is equal to the thickness dimension of conductive pattern 150. Thus each receiving terminal 153 has a main arm part 153*a* as a first terminal material, a supplementary arm part 153*b* as a second terminal material, and a protruding part 153*c* as a third terminal material.

The main arm part 153*a* is a material that primarily functions as a spring, and has a base part 153*a*1 connected to the edge of terminal receiving aperture 154, a beam part 153*a*2 connected to the base part 153*a*1, and a contact part 153*a*3 connected to the end of the beam part 153*a*. The beam part 153*a*2 is an approximately L-shaped material that functions as a spring, and the contact part 153*a*3 is flexibly displaced in the lateral direction of female connector 101, that is to say the lateral direction of terminal receiving aperture 154, by the spring action of beam part 153*a*.

Also, the supplementary arm part 153*b* is a material that functions as a supplementary spring absorbing excess penetration of protruding terminal 53, and has a base part 153*b*1 connected to the edge of terminal receiving aperture 154, a bean part 153*b*2 connected to the base part 153*b*1, and a contact part 153*b*3 connected to the end of the beam part 153*b*2. The bean part 153*b*2 is an approximately L-shaped material that functions as a spring, and is formed shorter than beam part 153*a*2 of the main arm part 153*a*. Also, the contact part 153*b*3 is flexibly displaced in the front-to-back direction of female connector 101, that is to say the vertical direction of terminal receiving aperture 154, by the spring action of beam part 154.

In addition, the protruding part 153*c* is formed so as to protrude from one part of the edge of terminal receiving aperture 154 extending in the vertical direction, in the direction of the opposing edge, and is a material performing the function of positioning of protruding terminal 53. The position of protruding part 153*c* with respect to the vertical direction of the terminal enclosing aperture 154 correspond approximately to a position between contact part 153*a*3 of main arm part 153*a* and contact part 153*b*3 of supplementary arm part 153*b*.

Also, the terminal receiving aperture 154 includes outer aperture 154*b* outside of receiving terminal 153, main inner aperture 154*a*, being an aperture on the inside of receiving terminal 153 formed on the inside of main arm part 153*a*, supplementary inner aperture 154*d*, being an aperture formed on the inside of supplementary arm part 153*b*, and positioning aperture 154*c* positioned surrounded by contact part 153*a*3 of main arm part 153*a*, and contact part 153*b*3 of supplementary arm part 153*b*, and protruding part 153*c*. The main inner aperture 154*a* is the part surrounding the penetration of the protruding terminal 53 as receiving terminal 153 mates with protruding terminal 53 of male connector 1, and the supplementary inner aperture 154*d* is the part allowing deflection of beam part 153*b*2 and contact part 153*b*3 of the supplementary arm part 153*b*, and the positioning aperture 154*c* is the part that positions protruding terminal 53 when mating is completed.

Note also that the main inner aperture 154*a* has a large surface area, and typically the width dimension thereof is larger than the width dimension of the end of protruding terminal 53, and also the dimension in the up-down direction thereof is larger than the dimension in the up-down direction of protruding terminal 53 as well. For this reason, protruding terminal 53 is able to penetrate smoothly into main inner aperture 154*a*. Further, positioning aperture 154*c* is a small space, and typically the measurement of the dimension between contact part 153*a*3 of main arm part 153*a*, contact part 153*b*3 of supplementary arm 153*b*, and protruding part 153*c*, is smaller than the diameter or width dimension of protruding terminal 53. For this reason, when protruding terminal 53 is contained within main inner aperture 154*a* and moves relative to positioning aperture 154*c*, contact part 153*a*3 of main arm part 153*a*, contact part 153*b*3 of supplementary arm 153*b*, and protruding part 153*c* are in contact with the side surface parts of protruding terminal 53 and the spaces between contact part 153*a*3 of main arm part 153*a*, contact part 153*b*3 of supplementary arm 153*b*, and protruding part 153*c* are pressed apart, and thus as a result of the spring action of main arm part 153*a* and supplementary arm part 153*b*, contact part 153*a*3 of main arm part 153*a*, contact part 153*b*3 of supplementary arm 153*b*, and protruding part 153*c* are in a state of pressure from the side surface parts of protruding terminal 53. In other words, contact part 153*a*3 of main arm part 153*a*, contact part 153*b*3 of supplementary arm 153*b*, and protruding part 153*c* are flexibly contained by the side surface parts of protruding terminal 53.

Note further that the shape of main inner aperture 154*a* is a shape that with dimensions that steadily decrease approaching positioning aperture 154*c*. Specifically, the inner edges in the range from the end of beam part 153*a*2 to contact part 153*a*2 of main arm part 153*a* have a sloping tapered shape. For this reason, protruding terminal 53 is able to smoothly penetrate into positioning aperture 154*c*.

Also, gourd-shaped retaining parts 157 each contain a base part 157*a* connected at the upper and lower edges of retaining part receiving aperture 159, and are divided into a left side part and a right side part having left-right symmetrical shapes. Also, each left side part and right side part have a first arm part 157*b* and second arm part 157*d* connected to each base part 157*a* above and below, as well as a raised part 157*c* connected to the ends of first arm part 157*b* and second arm part 157*d*.

In addition, retaining part receiving aperture 159 includes inner aperture 159*a* between the left side part and right side part, as well as outer aperture 159*b* on the outside of the left side part and right side part. Also, the inner aperture 159*a* contains a first inner aperture 159*a*1 between the left and right first arm parts 157*b*, and a second inner aperture 159*a*2 between the left and right second arm parts 157*d*. The first inner aperture 159*a*1 is the part that accepts the penetration of the protruding terminal 53 when retaining part 157 mates with protruding terminal 53 of male connector 1, and the second inner aperture 159*a*2 is the part that positions protruding terminal 53 when mating is completed.

Further, first inner aperture 159*a*1 and second inner aperture 159*a*2 preferably have a flat and approximately circular shape, the inner diameter of the first inner aperture 159*a* is greater than the outer diameter of the end of protruding terminal 53, and the inner diameter of second inner aperture 159*a* is less than the outer diameter of the end of protruding terminal 53. In such a case, protruding terminal 53 is able to smoothly penetrate into first inner aperture 159*a*1, and does not escape from second inner aperture 159*a*2 when mating is completed. Note also that the dimension of the part between left and right raised areas 157*c* corresponding to the boundary between the first inner aperture 159*a*1 and second inner aperture 159*a*2 is less than the diameter or width of a cross section of protruding terminal 53. For this reason, when protruding terminal 53 as contained within first inner aperture 159*a*1 moves relative to second inner aperture 159*a*2, the space between left and right raised parts 157*c* contacts and is pressed apart by the side surfaces of protruding terminal 53.

Note also that in the aforementioned base film 115, terminal corresponding apertures 115*c* and retaining part corresponding apertures 115*d* are respectively formed, passing through base film 115 in the thickness direction, at locations corresponding to each protruding terminal 153 and each retaining part 157. Typically, the terminal corresponding apertures 115*c* and retaining part corresponding apertures 115*d* have a long rectangular shape with a front-to-back dimension (the top-to-bottom dimension in FIG. 6) corresponding to terminal receiving aperture 154 and retaining part receiving aperture 159.

Also, the frame body 111 is a flat shaped material having a layered structure whereby a cover film 117 and a frame reinforcing layer 116 are stacked in that order on top of conductive patterns 150. The cover film 117 is a pair of insulative thin plate materials having the surface shape of approximately three sides of a box, and made of any type of material with insulative properties.

Figure 4:
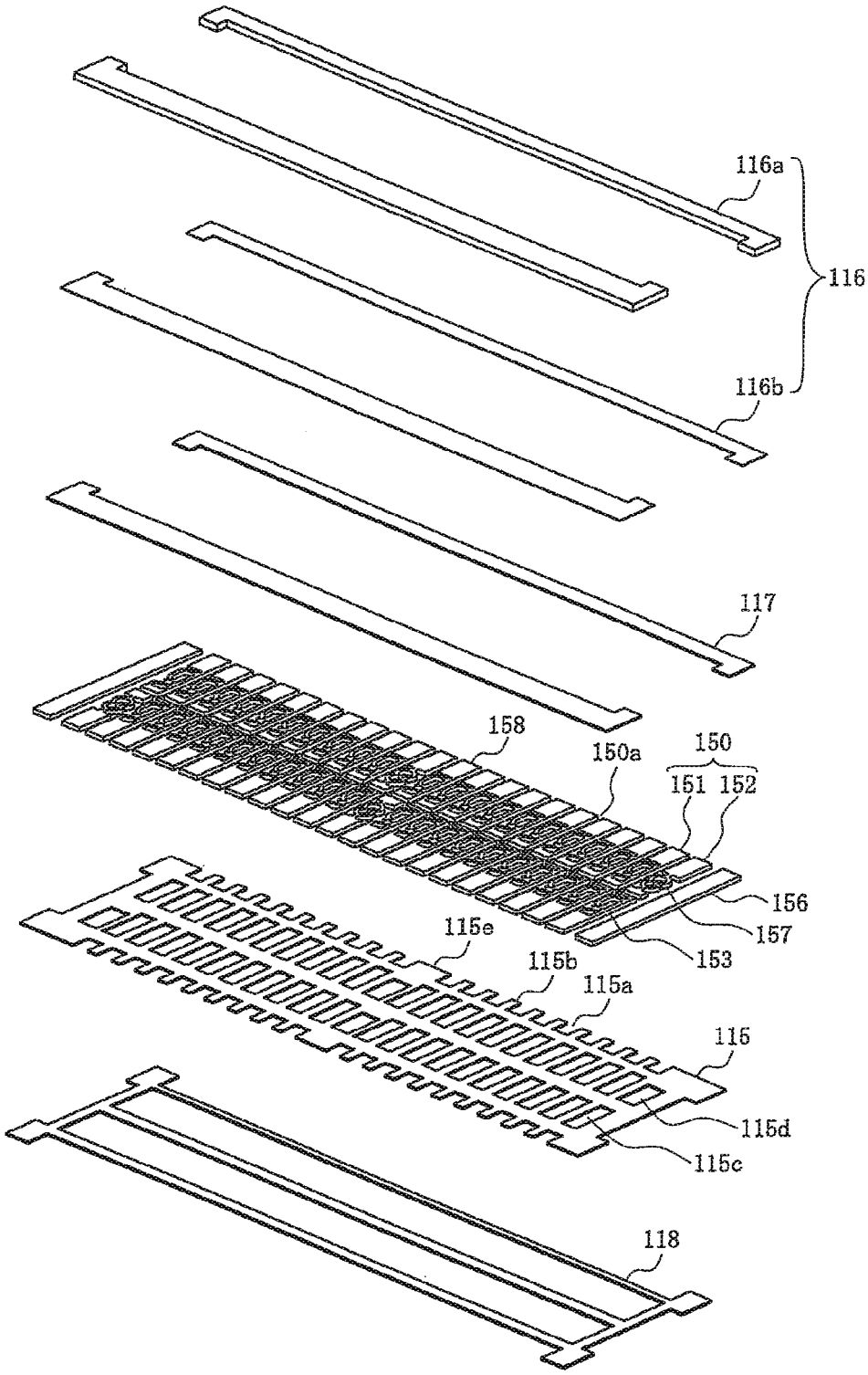
FIG. 4 is an exploded diagram showing the layer configuration of a second connector according to the first preferred embodiment of the Present Disclosure.

Note also that the frame reinforcing layer 116 may be a material structured by stacking a first reinforcing layer 116*a* and second reinforcing layer 116*b*, as shown in FIG. 4, and may also be a unitary material constructed as one unit. Also, no cover film 117 or frame reinforcing layer 116 is present at positions corresponding to mating recessed part 156*a* of vertical frame parts 111*b*. In other words, at the bottom of the mating recessed part 156*a*, reinforcing fixture 156 is exposed rather than being covered by cover film 117 and frame reinforcing layer 116.

Figure 8A:
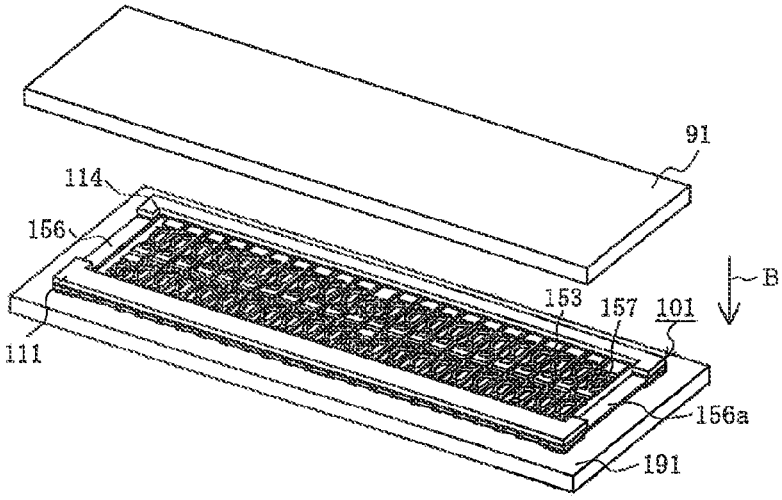
FIG. 8 is an illustration showing the process of joining of the first connector of FIG. 1 and the second connector of FIG. 4, whereby (*a*) through (*c*) show each stage thereof.
Figure 8B:
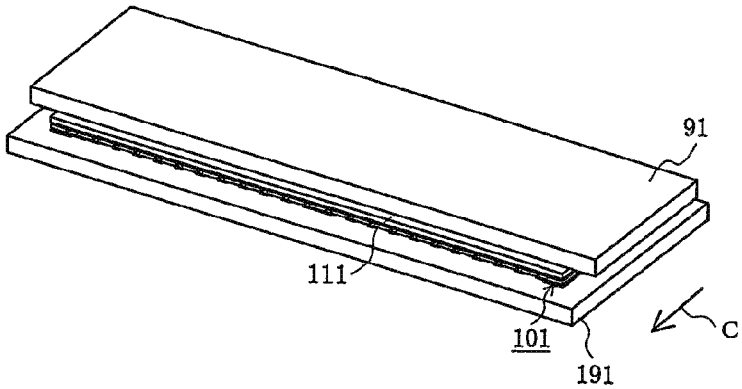
Figure 8C:
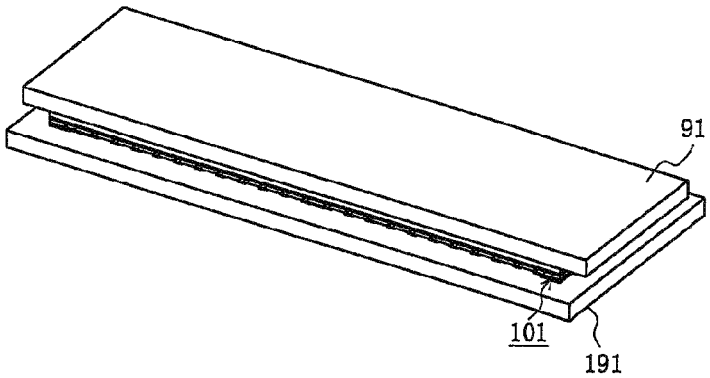

To join the male connector 1 and female connector 101, male connector 1 is previously surface mounted on first board 91, with tail parts 58 of conductive patterns 51 connected by soldering etc. to connecting pads, not shown formed on the front surface of first board 91 (the lower surface in FIG. 8(*a*)), and with a portion of the back surface of reinforcing fixture 56 connected by soldering etc. to fixing pads, not shown, formed on the front surface of first board 91. Also, female connector 101 is previously surface mounted on second board 191, with tail parts 158 of female conductive bodies 151 connected by soldering etc. to connecting pads, not shown, formed on the front surface of second board 191 (the upper surface in FIG. 8(*a*)), and with a portion of the back side of reinforcing fixtures 156 connected by soldering etc. to fixing pads, not shown, formed on the front surface of second board 191.

Figure 9C:
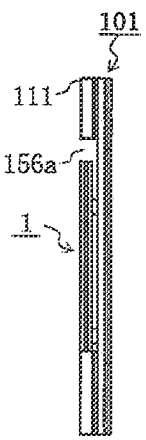
FIG. 9 is a series of illustrations showing the state of completed joining of the first connector of FIG. 1 and the second connector of FIG. 4, whereby (*a*) is a flat view, (*b*) is a front view, and (*c*) is a side view, all from the side of the mating surface of the second connector.
Figure 9A:
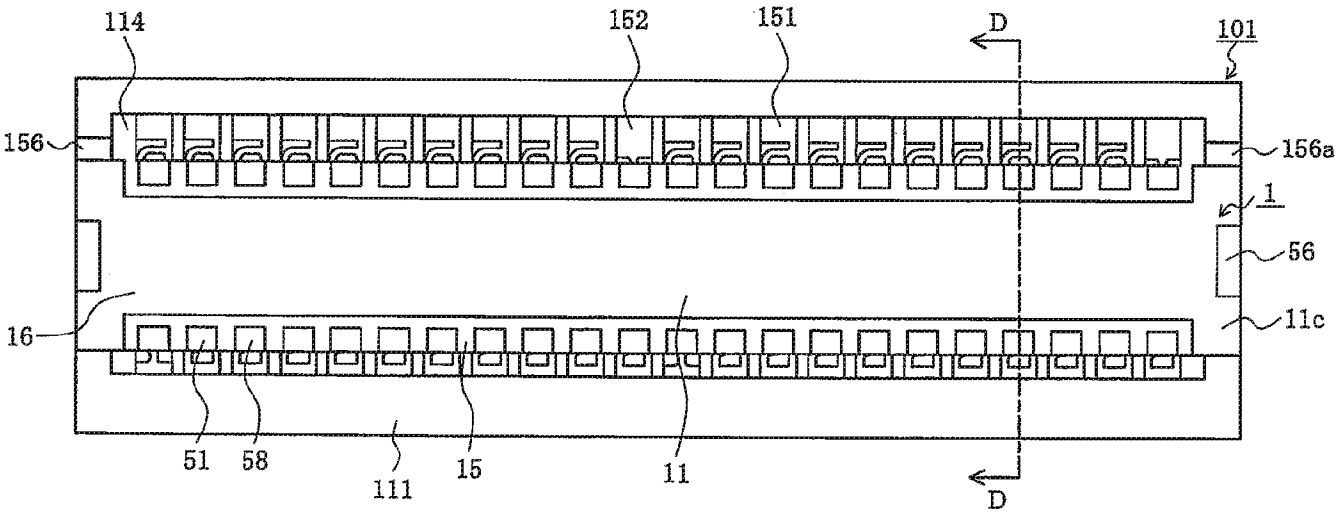
Figure 9B:
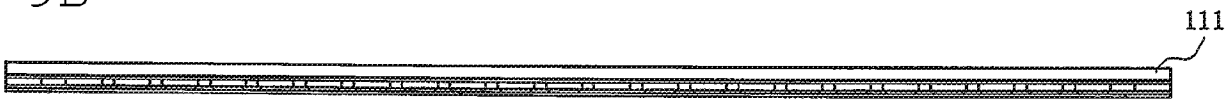
Figure 10B:
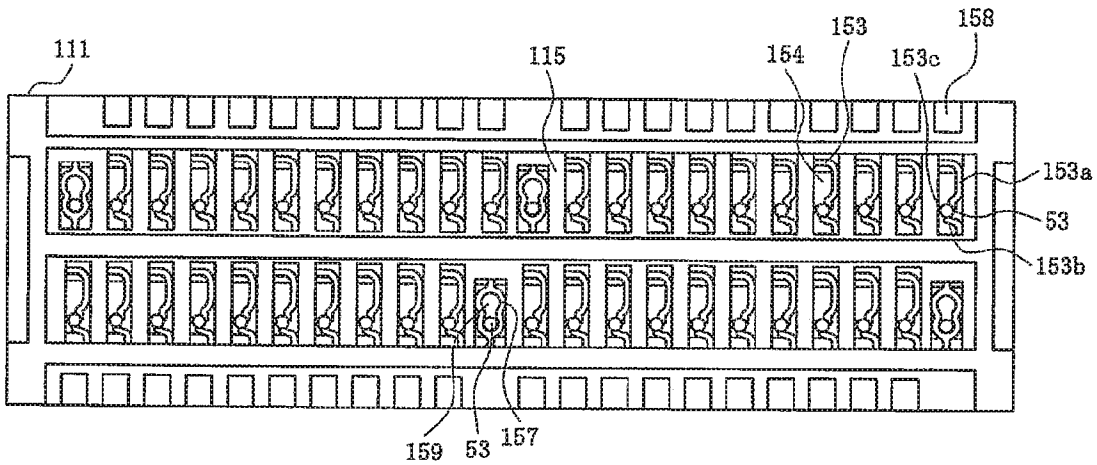
FIG. 10 is a series of illustrations of the state of completed joining of the first connector of FIG. 1 and the second connector of FIG. 4, whereby (*a*) is a cross sectional view along D-D in FIGS. 9(*a*), and (*b*) is a flat view from the mounting surface side of the second connector.
Figure 10A:
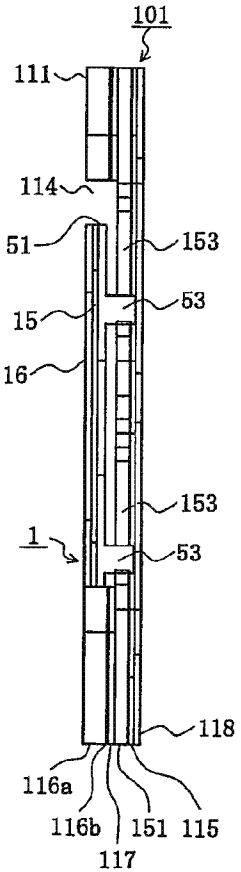

Note also that normally first board 91 and second board 191 are substantially larger than male connector 1 and female connector 101, however in FIG. 8 they are shown slightly larger than male connector 1 and female connector 101 for purposes of explanation. In addition, in FIGS. 9-10, first board 91 and second board 191 are omitted for purposes of explanation.

The operator, with the mating surface of male connector 1 and the mating surface of female connector 101 facing each other, lowers male connector 1 relative to female connector 101 as shown by arrow B in FIG. 8(*a*), and specifically causes the surface that is the mating surface of male connector 1 and the surface that is the mating surface of female connector 101 to be aligned, and to contact or approach each other by causing them to move in the direction of joining, such that the parts of main body 11 of male connector 1 other than main body end parts 11*c* are accommodated in connecting recessed part 114 of female connector 101.

By this means, the state shown in FIG. 8(*b*) is accomplished, whereby positioning in the left-right direction of male connector 1 and female connector 101 is accomplished as main body end parts 11*c* containing left and right reinforcing fixtures 56 of male connector 1 enter into left and right mating recessed areas 156*a* of female connector 101. Also, each protruding terminal 53 penetrates into main inner aperture 154*a* inside main arm part 153*a*, which is the inside of corresponding receiving terminal 153, and into first inner aperture 159*a*1 between first arm parts 157*b* which are inside retaining part 157.

Next, the operator slides male connector 1 in the locking direction relative to female connector 101, as shown by arrow C in FIG. 8(*b*). Specifically, by causing the surface of male connector 1 and the surface of female connector 101 to contact or approach each other, male connector 1 is caused to advance forward with respect to female connector 101. In this situation, each protruding terminal 53 penetrates into the main inner aperture 154*a* inside receiving terminal 153, and into the inner aperture 159*a* inside retaining part 157, that correspond to each protruding terminal 53, and left and right reinforcing fixtures 56 act as guides by sliding into a state of having penetrated into left and right mating recessed areas 156*a*, and thereby the position of male connector 1 with respect to female connector 101 does not become misaligned. Then, when joining of male connector 1 and female connector 101 is completed as shown in FIGS. 8(*c*), 9 and 10, each protruding terminal 53 has penetrated into inner positioning aperture 154*c* inside receiving terminal 153 and into second inner aperture 159*a* inside retaining part 157.

By this means, in receiving terminal 153, the space between contact part 153*a*3 of main arm part 153*a*, contact part 153*b*3 of supplementary arm 153*b*, and protruding part 153*c* is contacted and pushed apart by protruding terminal 53. Thus by the spring action of main arm part 153*a* and supplementary arm part 153*b*, contact part 153*a*3 of main arm part 153*a*, contact part 153*b*3 of supplementary arm 153*b*, and protruding part 153*c* are in a state of being pressed towards the side surfaces of protruding terminal 53. In other words, contact part 153*a*3 of main arm part 153*a*, contact part 153*b*3 of supplementary arm 153*b*, and protruding part 153*c* flexibly retain the side surface parts of protruding terminal 53. By this means, protruding terminals 53 and corresponding receiving terminals 153 are assured to be in contact and electrical conduction.

Note also that when a protruding terminal 53 penetrates into a positioning aperture 154*c*, its side surfaces go over and past protruding part 153*c*, and therefore receive return force. As a result the return force is transmitted to the hands and fingers of the operator as a click sensation. In other words the side surfaces of a protruding terminal 53 create a click sensation by moving over and past protruding part 153*c*.

Also, a protruding terminal 53 receives force applied in the front-to-back direction of female connector 101, or in other words the vertical direction of a terminal receiving aperture 154, and is pressed upon by protruding part 153*c* and contact part 153*a*3 of main arm 153*a*, as a result of the spring action of supplementary arm part 153*b* through contact part 153*b*3. By this means, positioning of protruding terminal 53 in the front-to-back direction of female connector 101, or in other words the vertical direction of terminal receiving aperture 154, is accomplished.

In addition, a protruding terminal 53 receives force in the lateral direction of female connector 101, or in other words the side-to-side direction of a terminal receiving aperture 154, by means of the spring action of beam part 153*a*2 of main arm 153*a* through contact part 153*a*3, and thus is pressed by the edges of terminal receiving aperture 154 facing protruding part 153*c* and beam part 153*a*2. By this means, positioning of protruding terminal 53 in the lateral direction of female connector 101, or in other words the side-to-side direction of terminal receiving aperture 154, is accomplished. In this manner, each protruding terminal 53 is accurately positioned in the vertical and horizontal direction of female connector 101 by the corresponding receiving terminal 153.

Also, on the inside of retaining part 157, a protruding part 53 is received by second inner aperture 159*a*2, which is smaller than first inner aperture 159*a*1. Thus when the protruding terminal 53 moves from the first inner aperture 159*a*1 into second inner aperture 159*a*2, the side walls thereof contact left and right raised parts 157*c* and press the raised parts 157*c* apart, and therefore receive return force. The return force is then transmitted to the hands and fingers of the operator as a click sensation. In other words, the side surface parts of a protruding terminal 53 create a click sensation by pressing raised parts 157*c* apart. Note also that a protruding terminal 53 has an end with a diameter greater than its other parts, and in the event that the diameter of second inner aperture 159*a*2 is smaller than the diameter of the end part of protruding terminal 53, once joining is completed it will be impossible to extract protruding terminal 53 from second inner aperture 159*a*. By this means displacement of male connector 1 in the counter-joining direction (the reverse direction of arrow B) with respect to female connector 101 is prevented.

Note also that this first preferred embodiment is described in terms of an example whereby a total of four retaining parts 157 are placed in the longitudinal direction of female connector 101 at both ends and in the center, however, the number and placement of retaining parts 157 may be varied as appropriate, and if necessary retaining part 157 may also be omitted. Also, the operations of releasing the joining of male connector 1 and female connector 101 are no more than the opposite of the operations for the purpose of joining male connector 1 and female connector 101, and therefore are omitted from the description.

Thus a board-to-board connector according to this first preferred embodiment comprises a male connector mounted on the surface of a first board 91, and a female connector mounted on the surface of a second board 191 and mating with male connector 1, and male connector 1 contains flat shaped main body part 11, conductive patterns 51 placed on the mating surface of main body part 11, and protruding terminals 31 protruding from the surface of conductive patterns 51, and female connector 101 is a flat material formed from flat sheet metal and contains receiving terminals 153 flexibly retaining protruding terminals 53, positioning of protruding terminal 53 and receiving terminal 153 is performed by the fact that protruding terminals 53 are retained by receiving terminals 153.

By this means it is possible to reduce the height dimension of male connector 1 and female connector 101, and also possible to maintain assured and stable positioning and contact of protruding terminals 53 and receiving terminals 153. Also, because an appropriate click sensation is created, it is possible to easily detect the completion of joining of male connector 1 and female connector 101. Furthermore, improved reliability is enabled along with ease of manufacturing, simple and low-cost structure, and compact size. Male connector 1 and female connector 101 are joined by mutually aligning and then sliding their respective mating surfaces together. By this means, first board 91 and second board 191 can be connected easily and with assurance.

Also, receiving terminals 153 contain main arm part 153*a*, supplementary arm part 153*b*, and protruding part 153*c*, formed by patterning of female conductive bodies 151 comprised of flat metal, the arm part 153*a* and supplementary arm part 153*b* contain base parts 153*a*1 and 153*b*1 connected to peripheral parts of receiving terminal 153 on female conductive bodies 151, as well as flexibly displacing contact parts 153*a*3 and 153*b*3, and beam parts 153*a*3 and 153*b*3 communicating with contact parts 153*a*3 and 153*b*3 and base parts 153*a*1 and 153*b*1, and the space between contact parts 153*a*3 and 153*b*3 of main arm part 153*a* and supplementary arm 153*b*, and protruding part 153*c* is smaller than the cross section of protruding terminal 53, and when receiving terminal 153 is joined with protruding terminal 53, contact parts 153*a*3 and 153*b*3 of main arm part 153*a* and supplementary arm 153*b*, and protruding part 153*c* are flexibly held by the side surface parts of protruding terminal 53. By this means, the state of contact between protruding terminal 53 and receiving terminal 153 is maintained with assurance, and the state of conduction between protruding terminals 53 and receiving terminals 153 is made stable. Also, positioning of protruding terminals 53 with respect to receiving terminals 153 in both the front-to-back and side-to-side directions of female connector 101 is made with assurance, and a click sensation is produced.

In addition, main inner apertures 154*a* formed on the inside of main arm parts 153*a* are larger than the cross section of protruding terminals 53, and after protruding terminals 53 penetrate into main inner apertures 154*a*, they move between and are held by contact parts 153*a*3 and 153*b*3 of main arm parts 153*a* and supplementary arm parts 153*b* and protruding parts 153*c*. By this means, it is possible for protruding terminals 53 to easily penetrate into main inner apertures 154*a*, and it is possible to easily perform the operation of joining male connector 1 and female connector 101.

Further, female connector 1 further contains retaining parts 157, which capture the click sensation generated when protruding terminal 53 is retained by receiving terminal 153, and each retaining part 157 contains a mutually facing pair of first arm part 157*b* and second arm part 157*d* formed from flat metal, as well as raised part 157*c*, which contacts the ends of first arm part 157*b* and second arm part 157*d*, and produces a click sensation when protruding terminal 53 penetrates between first arm parts 157*b*, and moves through and past between raised parts 157*c* and between second arm parts 157*d*. By this means, the click sensation is captured, and therefore the operator is able to know with certainty that protruding terminals 53 and receiving terminals 153 are in contact.

Next, we describe a second preferred embodiment of the Present Disclosure. Note that items having the same structure as the first preferred embodiment are assigned the same symbols and thus description thereof is omitted. Descriptions of operations and effects that are the same as in the aforementioned first preferred embodiment are also omitted.

Figure 11C:
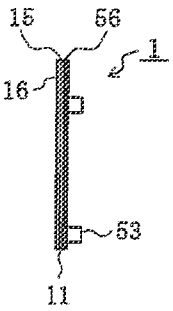
FIG. 11 is a series of illustrations of a first connector according to the second preferred embodiment of the Present Disclosure, whereby (*a*) is a top view, (*b*) is a front view, and (*c*) is a side view.
Figure 11A:
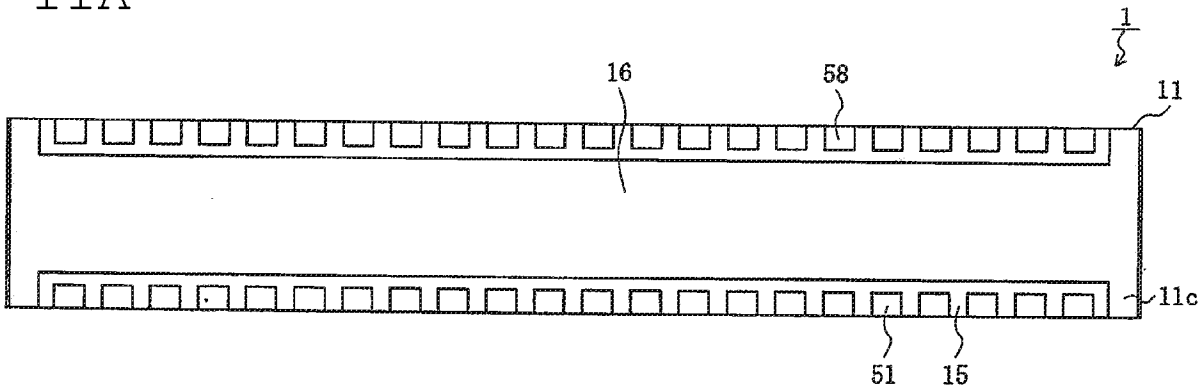
Figure 11B:
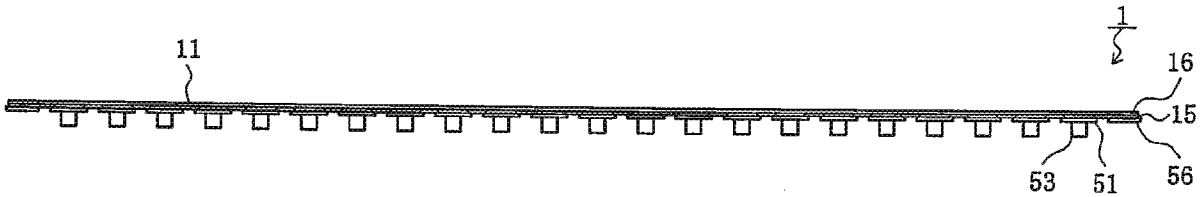

In male connector 1 according to this second preferred embodiment, as shown in FIG. 11, main body end parts 11*c* of main body part 11 do not contain cutout part 11*d*, but do contain catch parts 11*e* as male joining locking parts. The catch part 11*e* is a part extending outward from the outside edge of main body end 11*c*, and specifically is formed by extending the outside edge of reinforcing fixture 56 outward beyond the outer edges of base film end 15*c* and reinforcing layer end 16*c*. Note also that the outer edge on the mating surface side of the catch part 11*e* should preferably be formed in a tapered surface or a rounded surface as shown in FIG. 14.

Note also that other aspects of the structure of the male connector are identical to the aforementioned first preferred embodiment, and therefore description thereof is omitted.

Figure 12A:
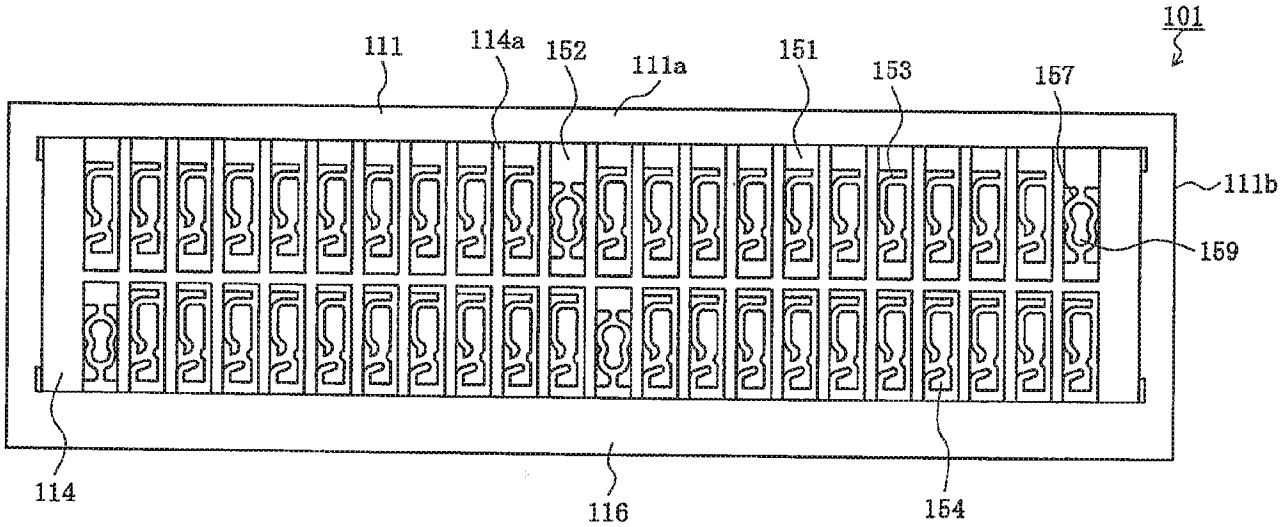
FIG. 12 is a series of illustrations of a second connector according to the second preferred embodiment of the Present Disclosure, whereby (*a*) is a top view, (*b*) is a front view, and (*c*) is a side view.
Figure 12B:
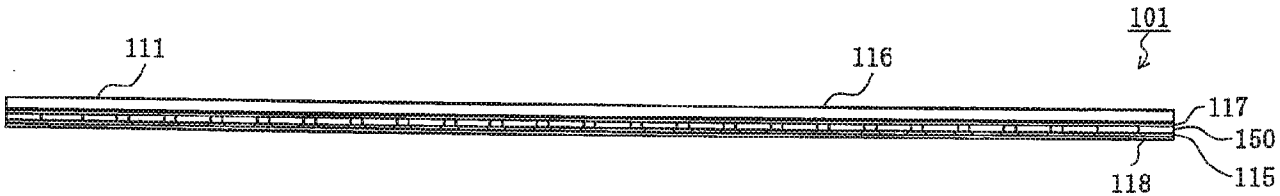
Figure 12C:
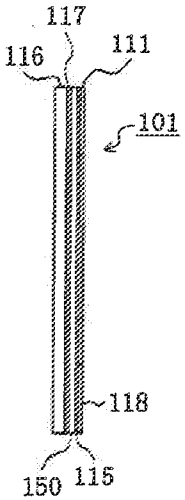
Figure 14A:
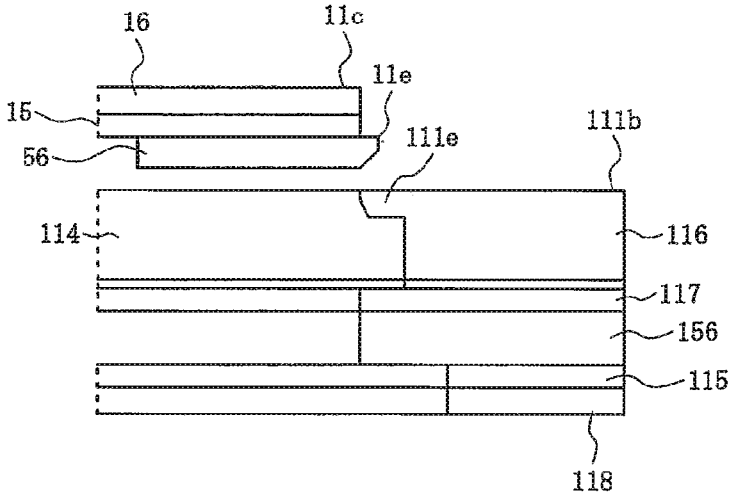
FIG. 14 is an expanded illustration of essential parts of the joining process of the first connector of FIG. 11 and the second connector according of FIG. 12, whereby (*a*) is an enlarged view of Part F in FIG. 13(*b*), and (*b*) is an oblique view corresponding to (*a*), and (*c*) is a view corresponding to (*a*) in the state where the main body part of the first connector is contained in the connecting recessed part of the second connector.
Figure 14B:
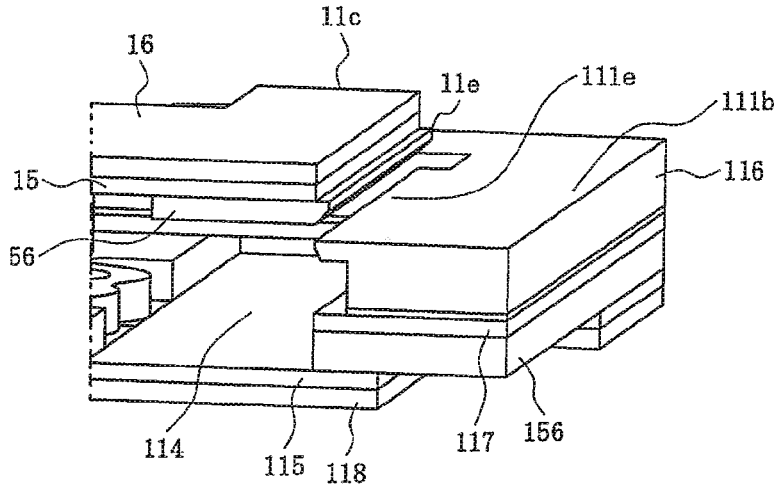
Figure 14C:
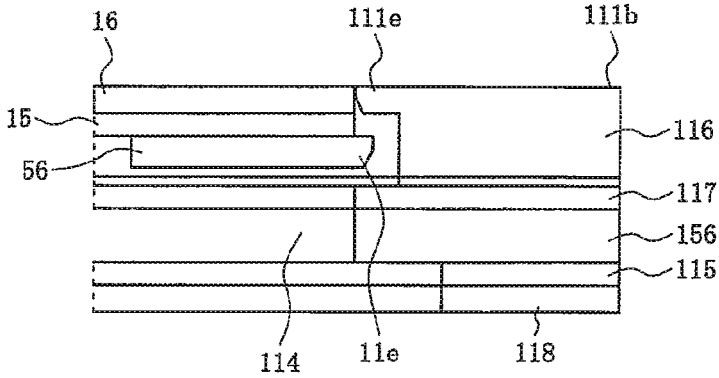

Also, in female connector 101 according to this second preferred embodiment, vertical frame parts 111*b* of frame 111 do not contain a mating recessed part 156*a* as shown in FIG. 12, and do contain catch parts 111*e* as female joining locking parts as shown in FIG. 14. The catch part 111*e* is a part extending inward from the inner end edge of vertical frame parts 111*b*, and specifically is formed by causing the inner end edge on the joining surface side of frame reinforcing layer 116 to protrude inwardly. Note also that a tapered surface or curved surface should preferably be formed on the inner end edges of the mounting surface side of the catch part 111*e*.

Thus, the distance between two inner end edges of catch parts 111*e* in left and right vertical frame parts 111*b* of female connector 101 is slightly shorter than the distance between two outer end edges of catch parts 111*e* in left and right main body end parts 11*c* of male connector 1. By this means, when male connector 1 and female connector 101 are joined, the inner end edges of catch parts 111*e* on left and right vertical frame parts 111*b* of female connector 101 contact the outer edge edges of catch parts 11*e* on left and right main body end parts 11*c* of male connector 1.

Also, whereas in the aforementioned first preferred embodiment parts of main body part 11 of male connector 1 other than main body end parts 11*c* are contained within connecting recessed area 114 of female connector 101, in this second preferred embodiment the entirety of main body part 11 including main body end parts 11*c* are contained within connecting recessed area 114. For this reason, the connecting recessed area 114 is larger than in the first preferred embodiment.

Note also that other points of the configuration of the female connector 101 are identical to the first preferred embodiment, and therefore description thereof is omitted.

Figure 13A:
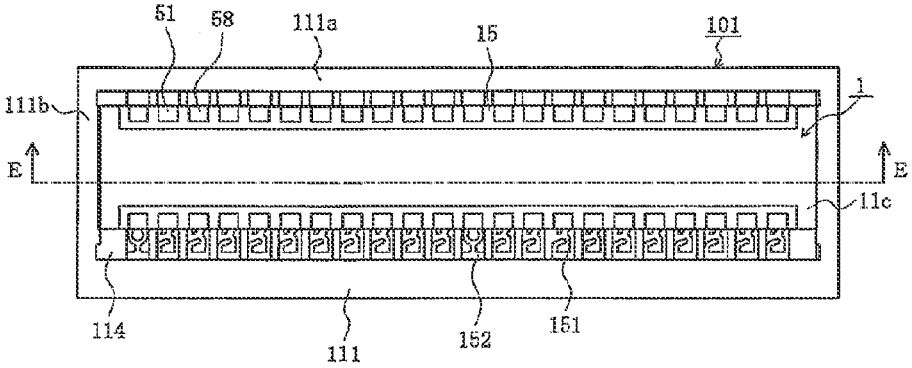
FIG. 13 is a series of illustrations of the state of completed joining of the first connector of FIG. 11 and the second connector of FIG. 12, whereby (*a*) is a flat view from the mating surface side of the second connector, and (*b*) is a cross sectional view along E-E in (*a*)
Figure 13B:
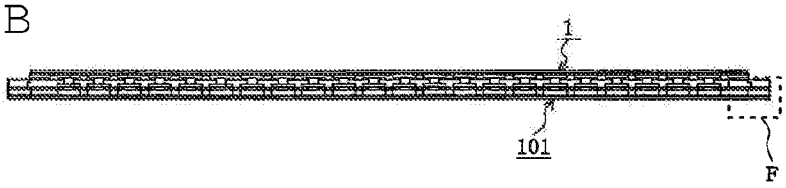

In addition, in this second preferred embodiment, when joining male connector 1 and female connector 101, the operator aligns the mating surface of male connector 1 and the mating surface of female connector 101, and in that state lowers male connector 1 relative to female connector 101, as shown in FIG. 13. Specifically, as described above, the inner end edges of catch parts 111*e* on left and right vertical frame parts 111*b* of female connector 101 correspond with the outer end edges of catch parts 11*e* in left and right main body end parts 11*c* of male connector 1, as shown in FIGS. 14(*a*) and (*b*).

Then, as the operator lowers male connector 1 relatively to female connector 101, main body part 11 containing main body end parts 11*c* of male connector 1 is accommodated in contact recessed area 114 of female connector 101, as shown in FIG. 14(*c*). As this occurs, the outer end edges of catch parts 11*e* on left and right main body end parts 11*c* of male connector 1 contact the inner end edges of catch parts 111*e* on left and right vertical frame parts 111*b* of female connector 101, and thereby are flexibly displaced, and move past the inner edge ends of catch parts 111*e* and move downward on the inner edge ends of catch parts 111*e*. Also, the return force received when the outer edge ends of catch parts 11*e* move past the inner edge ends of catch parts 111*e* is transmitted to the hands and fingers of the operator and felt as a click sensation. In other words, a click sensation is generated by the moving of the outer edge ends of catch parts 11*e* over and past the inner edge parts of catch parts 111*e*. In addition, it is by means of the mating of the outer end edges of catch part 11*e* and the inner end edges of catch parts 111*e* that displacement of male connector 1 opposite to the direction of joining with respect to female connector 101 (opposite to arrow B) is prevented.

Thus, by the accommodation of main body part 11 by contact recessed part 114, the surfaces that are the mating surfaces of male connector 1 and the surfaces that are the mating surfaces of female connector 101 are brought into contact or close proximity, and each protruding terminal 53 penetrates into a main inner aperture 154*a* inside main arm part 153*a*, the inner side of the corresponding receiving terminal 153, and into first inner aperture 159*a*1 between first arm parts 157*b*, the inner side of retaining part 157.

Next, the operator slides male connector 1 in the locking direction relatively to female connector 101, and the operation thereafter is the same as in the situation of the aforementioned first preferred embodiment and thus description thereof is omitted. In this manner, in this second preferred embodiment, main body part 11 of male connector 1 contains catch parts 11*e* extending outward from main body end parts 11*c* on the longitudinal ends thereof, female connector 101 contains connecting recessed part 114 that accommodates main body part 11 of male connector 1, and frame 111 that defines the perimeter of connecting recessed part 114, and frame 111 contains catch parts 111*e* extending inward from the inner end edges of vertical frame parts 111*b* positioned at both longitudinal ends thereof, and when main body part 11 of male connector 1 is accommodated by connecting recessed part 114 of female connector 101, catch parts 11*e* of main body part 11 and catch parts 111*e* of frame 111 lock together. By this means, displacement of male connector 1 opposite to the direction of joining with respect to female connector 101 is prohibited, and therefore it is possible to accurately maintain a state of joining of male connector 1 and female connector 101. Also, the operator is able to know with certainty that main body part 11 of male connector 1 has been accommodated in connecting recessed part 114 of female connector 101 because a click sensation is generated when main body part 11 of male connector 1 is accommodated by connecting recessed part 114 of female connector 101.

Next, we describe a third preferred embodiment of the Present Disclosure. Note in regard to items having identical configuration to the first and second preferred embodiment that the same symbols are assigned and thus description thereof is omitted. Also, description is omitted of operation and effects that are the same as in the first and second preferred embodiment.

The configuration of male connector 1 in this third preferred embodiment is the same as in the aforementioned second preferred embodiment, and therefore description thereof is omitted.

Figure 15C:
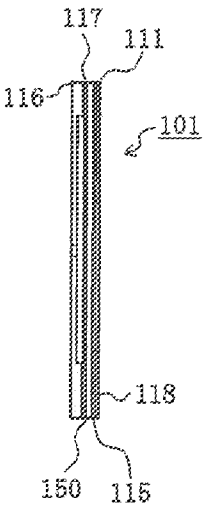
FIG. 15 is a series of illustrations of a second connector according to the third preferred embodiment of the Present Disclosure, whereby (*a*) is a top view, (*b*) is a front view, and (*c*) is a side view.
Figure 15A:
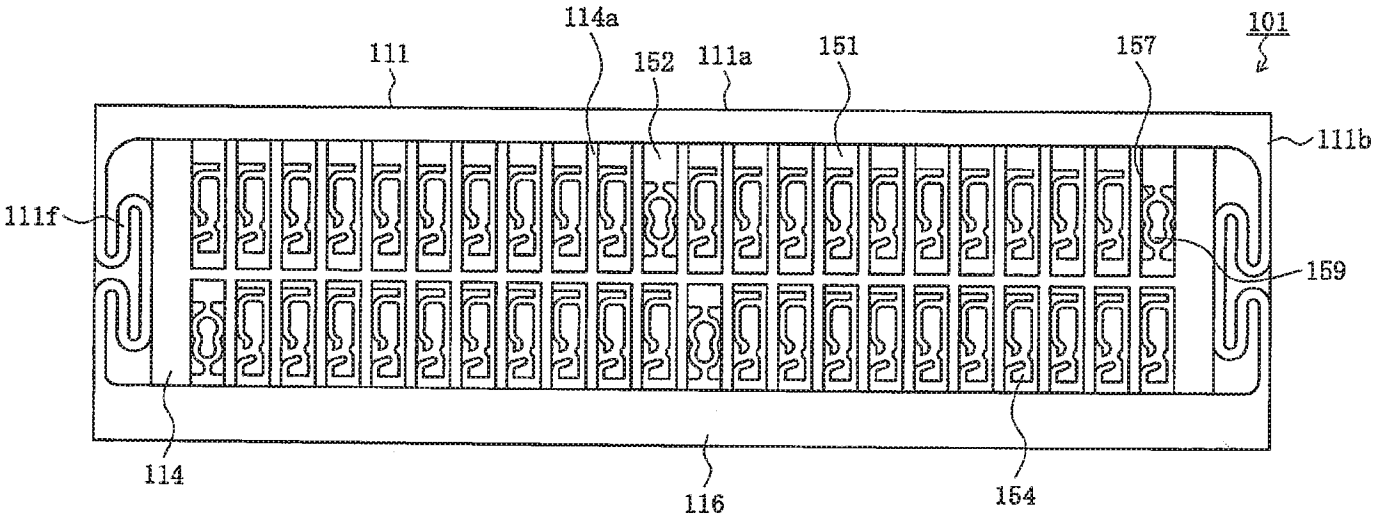
Figure 15B:
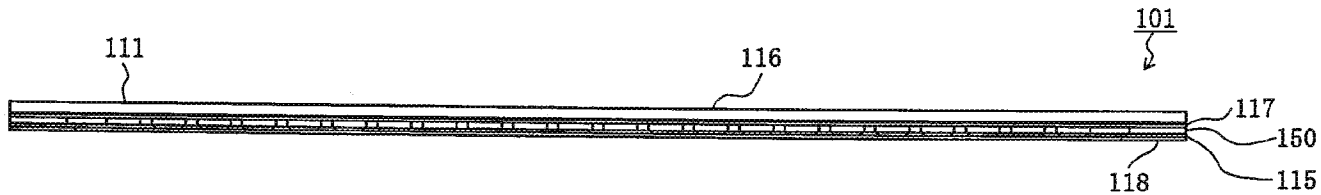

Also, in female connector 101 in this third preferred embodiment, vertical frame parts 111*b* of frame 111 contain spring part 111*f* but do not contain either mating recessed area or catch parts 111*e*, as shown in FIG. 15. The spring part 111*f* is a part that functions as a female mating locking part, and specifically is formed by making a part of the mounting surface of frame reinforcing layer 116 thin and forming it into a flat shape like two successive S shapes. Note also that in this third preferred embodiment frame reinforcing layer 116 should preferably be made of a material having flexibility such as metal.

Also, the distance between inner end edges of spring parts 111*f* of left and right vertical frame parts 111*b* of female connector 101 is slightly shorter than the distance between outer end edges of catch parts 111*e* of left and right main body end parts 11*c* of male connector 1. By this means, when male connector 1 and female connector 101 are joined, the inner end edges of spring parts 111*f* on left and right vertical frame parts 111*b* of female connector 101 come into contact with the outer end edges of catch parts 11*e* of left and right main body ends 11*c* of male connector 1.

Note also that other aspects of the female connector 101 are identical to the aforementioned second preferred embodiment, and therefore description thereof is omitted.

Figure 16A:
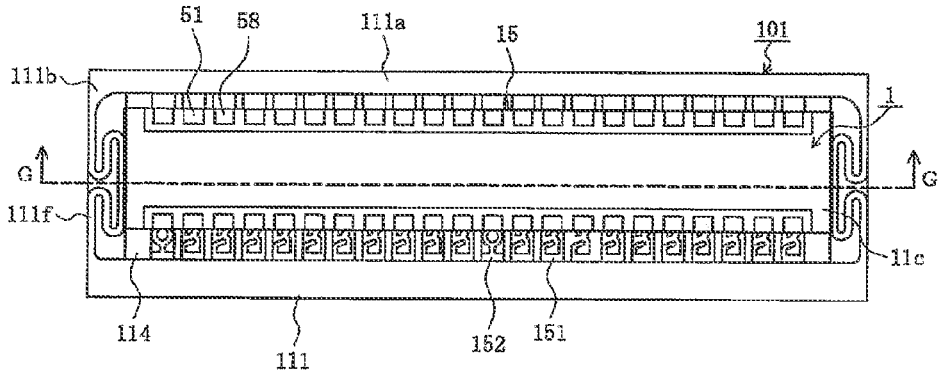
FIG. 16 is a series of illustrations of the state of completed joining of a first connector and a second connector according to the third preferred embodiment of the Present Disclosure, whereby (*a*) is a flat view from the mating surface side of the second connector, and (*b*) is a cross sectional view along G-G in (*a*)
Figure 16B:
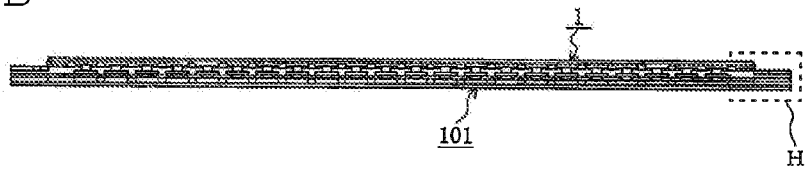

Also, in this third preferred embodiment, when joining male connector 1 and female connector 101, the operator aligns the mating surface of male connector 1 and the mating surface of female connector 101, and in that state lowers male connector 1 relative to female connector 101, as shown in FIG. 16. Specifically, as described above, the inner end edges of spring parts 111*f* on left and right vertical frame parts 111*b* of female connector 101 correspond with the outer end edges of catch parts 11*e* in left and right main body end parts 11*c* of male connector 1, as shown in FIGS. 17(*a*)-(*b*).

Figure 17A:
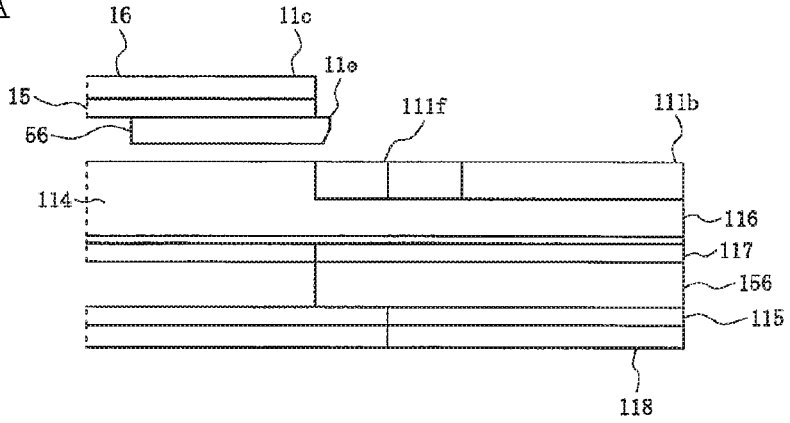
FIG. 17 is an expanded illustration of the essential parts of the joining process of the first connector of FIG. 16 and the second connector of FIG. 15, whereby (*a*) is an enlarged view of Area H of FIGS. 16(*b*), and (*b*) is an oblique view corresponding to (*a*), and (*c*) is a view corresponding to (*a*) in the state where the main body part of the first connector is contained in the connecting recessed part of the second connector.
Figure 17B:
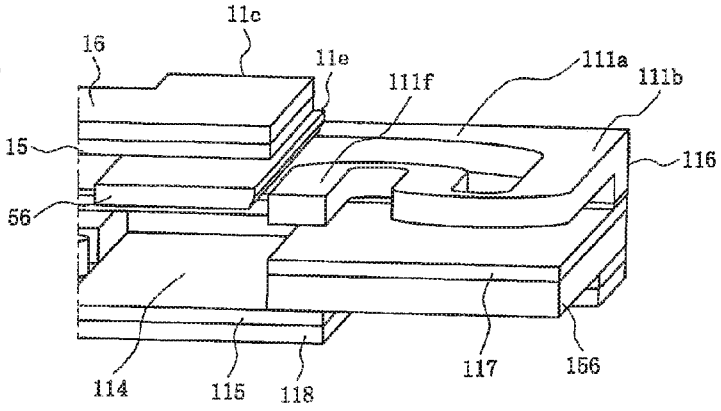
Figure 17C:
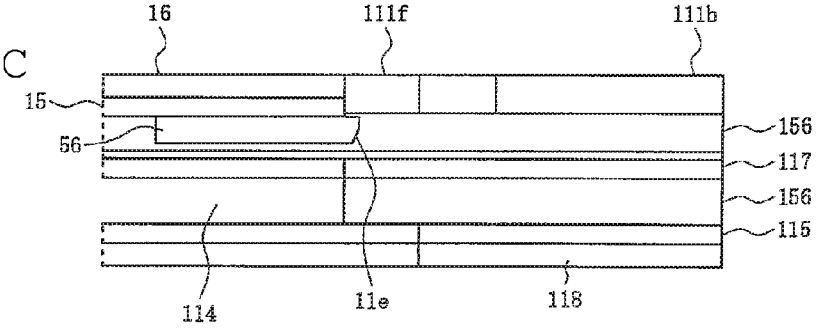
Figure 18:
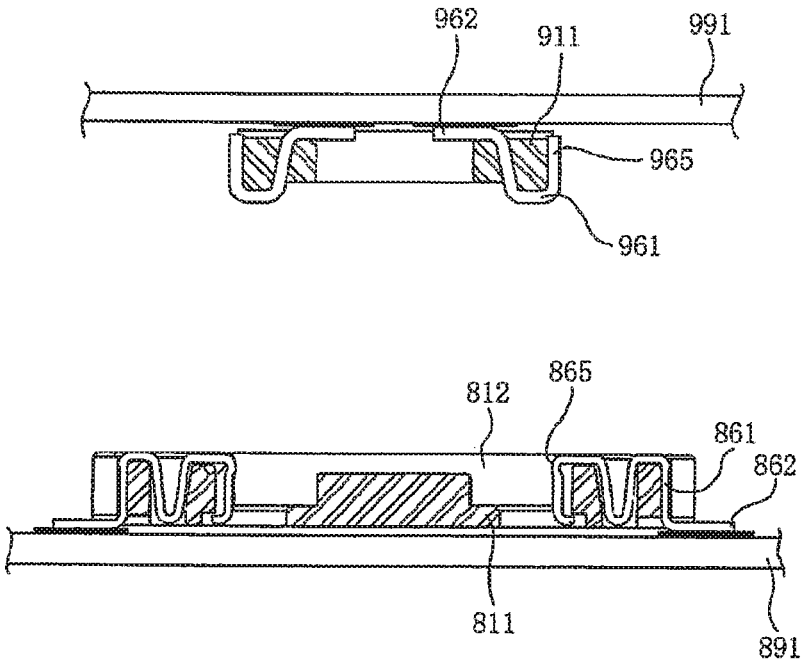
FIG. 18 Prior art
FIG. 18 is a cross sectional view showing a conventional board-to-board connector.

Then, as the operator lowers male connector 1 relatively to female connector 101, main body part 11 containing main body end parts 11*c* of male connector 1 is accommodated in contact recessed area 114 of female connector 101, as shown in FIG. 17(*c*). As this occurs, the inner end edges of spring parts 111*f* on left and right main body end parts 11*c* of male connector 1 contact the outer end edges of catch parts 111*e* on left and right vertical frame parts 111*b* of female connector 101, and thereby are flexibly displaced, and the inner end edge parts are flexibly displaced outwardly. As a result, the outer end edges of catch parts 11*e* are able to move over and past the inner end edges of spring parts 111*f* and downward along the inner end edges of spring parts 111*f*. Also, the return force received when the outer edge ends of catch parts 11*e* move past the inner edge ends of spring parts 111*f* is transmitted to the hands and fingers of the operator and felt as a click sensation.

In other words, a click sensation is generated by the moving of the outer edge ends of catch parts 11*e* over and past the inner edge parts of catch parts 111*f*. In addition, it is by means of the mating of the outer end edges of catch part 11*e* and the inner end edges of catch parts 111*f* that displacement of male connector 1 opposite to the direction of joining with respect to female connector 101 (opposite to arrow B) is prevented.

Further, the spring parts 111*f* flexibly return to their original shape and the inner end edges thereof flexibly displace inward, contacting and pressing against the outer end edges of base film 15 and reinforcing layer 16 in left and right main body end parts 11*c* of male connector 1. As a result, main body part 11 of male connector 1 is placed in a state of being flexibly retained from both sides by left and right spring parts 111*f* of female connector 101, and therefore positioning of male connector 1 and female connector 101 in the longitudinal direction is determined.

Note also that in this third preferred embodiment spring parts 111*f* are formed in a flat shape so as to have a flat shape like two successive S shapes, however they may be of any shape having flexibility. Thus, by the accommodation of main body part 11 by contact recessed part 114, the surfaces that are the mating surfaces of male connector 1 and the surfaces that are the mating surfaces of female connector 101 are brought into contact or close proximity, and each protruding terminal 53 penetrates into main inner aperture 154*a* inside main arm part 153*a*, the inner side of the corresponding receiving terminal 153, and into first inner aperture 159*a* between first arm parts 157*b*, the inner side of retaining part 157.

Next, the operator slides male connector 1 in the locking direction relatively to female connector 101, and the operation thereafter is the same as in the situation of the aforementioned first preferred embodiment and thus description thereof is omitted. In this manner, in this second preferred embodiment, main body part 11 of male connector 1 contains catch parts 11*e* extending outward from main body end parts 11*c* on the longitudinal ends thereof, female connector 101 contains connecting recessed part 114 that accommodates main body part 11 of male connector 1, and frame 111 that defines the perimeter of connecting recessed part 114, and frame 111 contains spring parts 111*f* formed on vertical frame parts 111*b* positioned at both longitudinal ends thereof, and when main body part 11 of male connector 1 is accommodated by connecting recessed part 114 of female connector 101, catch parts 11*e* of main body part 11 and spring parts 111*f* of frame 111 lock together. By this means, displacement of male connector 1 opposite to the direction of joining with respect to female connector 101 is prohibited, and therefore it is possible to accurately maintain a state of joining of male connector 1 and female connector 101. Also, main body part 11 of male connector 1 is in a state of being flexibly retained from both sides by left and right spring parts 111*f* of female connector 101, and therefore positioning of male connector 1 and female connector 101 in the longitudinal direction is accomplished. In addition, the operator is able to know with certainty that main body part 11 of male connector 1 has been accommodated in connecting recessed part 114 of female connector 101 because a click sensation is generated when main body part 11 of male connector 1 is accommodated by connecting recessed part 114 of female connector 101.

While a preferred embodiment of the Present Disclosure is shown and described, it is envisioned that those skilled in the art may devise various modifications without departing from the spirit and scope of the foregoing Description and the appended Claims.

What is claimed is:

1. A board-to-board connector, the board-to-board connector comprising;

a first connector, the first connector being mounted on a surface of a first board and including a flat-shaped main body part, a first conductive body placed on a mating surface of the main body part and a plurality of male terminal protruding from the surface of the first conductive body; and a second connector, the second connector is a flat material formed from flat-shaped metal, being mounted on a surface of a second board and mating with the first connector and including a plurality of female terminals, each female terminal flexibly retaining one of the male terminals;

wherein the positioning of each male terminal and each female terminal is accomplished by each male terminals being retained by one of the female terminals.

2. The board-to-board connector according to claim 1, wherein, after the mating surfaces of the first and second connector are mutually aligned, they are joined by sliding together.

3. The board-to-board connector according to 2, wherein each female terminal contains a first terminal material, a second terminal material and a third terminal material, each terminal material formed by patterning a second conductive body formed of flat-shaped metal.

4. The board-to-board connector according to claim 3, wherein the first and second terminal materials include a base part contacted by peripheral parts of one of the female terminals, flexibly displaceable contact parts, and beam parts linking the contact parts with the base part.

5. The board-to-board connector according to claim 4, wherein the spaces between the contact parts of the first, second and third terminal materials are smaller than the cross section of the male terminals.

6. The board-to-board connector according to claim 5, wherein, when the female terminals are joined with the male terminals, the contact parts of the first, second and third terminal materials flexibly retain side surfaces of the male terminals.

7. The board-to-board connector according to claim 6, wherein an aperture is formed on the inside of the first terminal material.

8. The board-to-board connector according to claim 7, wherein the aperture is larger than the cross section of the male terminals.

9. The board-to-board connector according to claim 8, wherein each male terminal, after being inserted into the aperture, moves between the third terminal material and the contact part of the first and second terminal materials.

10. The board-to-board connector according to claim 9, wherein each male terminal and is retained by the third terminal material and the contact part of the first and second terminal materials.

11. The board-to-board connector according to claim 10, wherein the second connector further includes a click sensation supplying material, the click sensations supplying material supplying a click sensation generated when one of the male terminals is retained by one of the female terminals.

12. The board-to-board connector according to claim 11, wherein the click sensation supplying material is formed of flat-shaped metal, and includes a mutually-facing pair of first and second arm parts, and a raised part connecting the ends of the first arm part and second arm part.

13. The board-to-board connector according to claim 12, wherein a click sensation is generated when one of the male terminals, having penetrated between two of the first arms, passes between the raised areas, and moves between the second arms.

14. The board-to-board connector according to claim 13, wherein the main body part of the first connector includes catch parts extending outward from both longitudinal ends thereof.

15. The board-to-board connector according to claim 14, wherein the second connector further includes a connecting recessed area accommodating the main body part of the first connector.

16. The board-to-board connector according to claim 15, wherein the second connector further includes a frame defining the perimeter of the connecting recessed area.

17. The board-to-board connector according to claim 16, wherein the frame includes catch parts extending outward from the inner end edges of vertical frame parts positioned at both longitudinal ends thereof.

18. The board-to-board connector according to claim 17, wherein, when the main body part of the first connector is accommodated in the connecting recessed area of the second connector, the main body part catch parts and the frame catch parts lock together.

19. The board-to-board connector according to claim 18, wherein the frame further includes spring parts formed on vertical frame parts and positioned at both longitudinal ends thereof.

20. The board-to-board connector according to claim 18, wherein, when the main body part of the first connector is accommodated in the connecting recessed area of the second connector, the main body catch parts and the frame spring parts lock together.

* * * * *